US007438114B2

(12) United States Patent
Fowler

(10) Patent No.: US 7,438,114 B2
(45) Date of Patent: Oct. 21, 2008

(54) REINFORCED GARAGE DOOR ASSEMBLY

(76) Inventor: Darrell D. Fowler, 6666 Stuart Avenue, Jacksonville, FL (US) 32254

( * ) Notice: Subject to any disclaimer, the term of this patent is extended or adjusted under 35 U.S.C. 154(b) by 298 days.

(21) Appl. No.: 11/373,464

(22) Filed: Mar. 10, 2006

(65) Prior Publication Data

US 2007/0209766 A1 Sep. 13, 2007

(51) Int. Cl.
*E05D 15/26* (2006.01)

(52) U.S. Cl. ..... 160/209; 160/234

(58) Field of Classification Search ..... 160/209, 160/201, 181, 233, 234, 207, 182; 292/DIG. 36, 292/DIG. 40, DIG. 46, 162
See application file for complete search history.

(56) References Cited

U.S. PATENT DOCUMENTS

| | | | | |
|---|---|---|---|---|
| 3,424,223 | A * | 1/1969 | Rosenblatt | 160/209 |
| 3,443,625 | A | 5/1969 | Moser et al. | |
| 5,383,509 | A * | 1/1995 | Gaffney et al. | 160/209 |
| 5,445,207 | A | 8/1995 | Romanelli et al. | |
| 5,706,877 | A | 1/1998 | Grisham et al. | |
| 5,732,758 | A * | 3/1998 | Marko | 160/201 |
| 5,819,834 | A | 10/1998 | Wedekind | |
| 5,964,269 | A * | 10/1999 | Decola | 160/209 |
| 6,776,210 | B2 * | 8/2004 | Wells | 160/209 |
| 6,796,361 | B1 * | 9/2004 | Campbell et al. | 160/209 |

* cited by examiner

*Primary Examiner*—David Purol
(74) *Attorney, Agent, or Firm*—Thomas C. Saitta

(57) ABSTRACT

A reinforcement assembly for a panel garage door, the assembly having multiple sliding locking members that are repositioned from a neutral or disengaged position on panel stiles to an active or engaged position bridging the hinge connecting adjacent stiles, such that adjacent panels are precluded from pivoting. Preferably, header and footer engagement assemblies are also provided to secure the door to the header and floor.

13 Claims, 4 Drawing Sheets

REINFORCED GARAGE DOOR ASSEMBLY

BACKGROUND OF THE INVENTION

This invention relates generally to the field of sectional doors comprised of multiple, laterally extensive, panel members, where opening and closing the door is accomplished by raising and lowering the panels on tracks, and more particularly to the field of such doors wherein the door assembly is provided with additional reinforcement members to better secure the door against high wind damage.

Sectional or panel-type doors that are raised vertically are well known for covering large openings in residences or commercial buildings, a typical situation being that of an opening in a garage of sufficient size for passage of one or two automobiles. The sections or panels are elongated in the lateral direction so as to cover the full width of the opening and are relatively short in the vertical dimension. This allows the door to be raised and lowered by providing a pair of track members, the track members extending vertically along the sides of the door opening and then transitioning to a horizontal disposition within the interior of the building. The short vertical height of the sections or panels allows each panel to transition from a vertical orientation to a horizontal one over a short curved section of the tracks. Most such doors are opened and closed with remote controlled, motorized openers.

Each section or panel is typically composed of a relatively thin and lightweight material, such as aluminum sheet metal, and is formed with turned in upper and lower horizontal edges. Bracing in the form of vertical stiles and horizontal rails is typically provided to increase the rigidity of the panel. Adjacent panels are connected with hinge members to allow movement out of the co-planar configuration. Roller members are attached to each side of some or all of the panels, the rollers seating within guide track members mounted in fixed relation to the building.

Because the panel doors must be lifted either manually or by a motorized opener, the overall weight of the door assembly is by necessity kept low to reduce the work needed to raise the door. This lightweight construction, however, is detrimental in high wind circumstances, particularly during tornadoes or hurricanes, where extremely high external forces may be applied against the door, both in the inward direction and, by generation of external low pressure conditions, in the outward direction. Typical panel door assemblies are often not able to handle such load or suction situations without incurring buckling damage or catastrophic failure. Newer building codes in hurricane-prone areas have raised the standards for the load and suction resistance of panel doors, both inwardly and outwardly, beyond that of many typical panel door constructions.

It is an object of this invention to provide a reinforcement system or assembly for panel or sectional garage doors whereby the doors are sufficiently reinforced to eliminate or severely reduce damage from high wind circumstances. It is a further object to provide such an assembly that can be incorporated during manufacture or provided as an add-on feature to existing panel doors. It is a further object to provide such an assembly that is easy to engage and disengage, and which does not interfere with the normal operation of the door when in the disengaged mode. It is a further object to provide such an assembly that does not greatly depart from the standard door design, such that the assembly is not obtrusive or interfering to normal operations in the vicinity of the door. These and other unnamed objects and advantages of the invention will be disclosed and described below.

SUMMARY OF THE INVENTION

The invention is in general a reinforcing, supporting and locking assembly for a sectional or panel door of the garage door type, for protection from damage in high wind situations, where the door is comprised of multiple laterally-extending, co-planar, panel members joined by hinge members that allow the panels to pivot relative to each other, the panels being provided with rollers that seat in a pair of track members. Vertically oriented bracing stiles are disposed on the interior side of the panels, with the hinge members positioned between the stiles.

Multiple panel reinforcement assemblies are provided, each of the reinforcement assemblies comprising channel members secured to the stiles above and below a hinge member. The channel members are generally U-shaped and comprise a base plate and a pair of longitudinally extending sides with oppositely turned flange members, the flange members defining longitudinally extending slots. Mounted to one of the channel members in a sliding manner is a locking member, also generally U-shaped and comprising a longitudinally extending top plate and a pair of longitudinally extending oppositely turned flange members, the flange members defining longitudinally extending slots. The flanges and slots of the channel member and the locking member cooperate to define sliding retention means, whereby with the locking member mounted onto the channel member, the locking member can be moved from a neutral or disengaged position to an active or engaged position spanning the hinge member and mated with the opposing channel member. In this engaged position with the locking member extending between both channel members the adjacent panels are now fixed in co-planar alignment, and the presence of a plurality of such reinforcement assemblies extending between the panels greatly increases the rigidity, strength and load/suction resistance of the door assembly.

To further secure the panel door, the invention further comprises header engagement assemblies, whereby reinforcement members extend across the gap between the upper door panel and the header, and footer engagement assemblies, whereby reinforcement members extend across the gap between the lower door panel and the floor. The header and footer engagement assemblies also have engaged and disengaged modes.

DETAILED DESCRIPTION OF THE INVENTION

Figure 1:
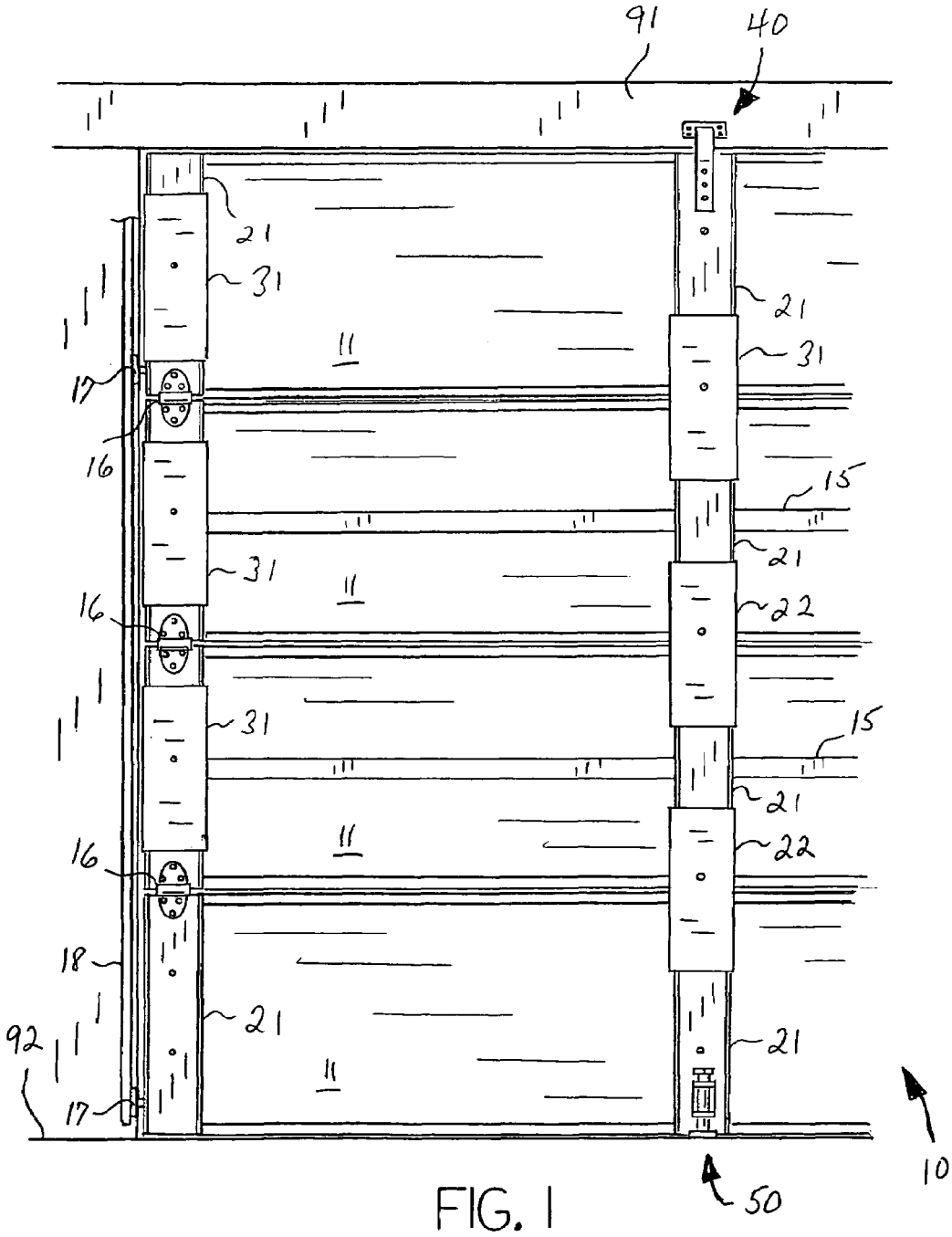
FIG. 1 is a partial view of a representative panel door showing the components of the reinforcement assembly.

With reference to the drawings, the invention will now be described in detail with regard for the best mode and the preferred embodiment. In a most general sense, the invention is a reinforcement, support and locking assembly for a paneled or sectioned door that opens in a vertical manner, such as a typical residential garage door, wherein the reinforcement assembly strengthens and increases the rigidity of the panel door assembly such that the panel door is less susceptible to damage due to high wind conditions. The term panel door or garage door shall be taken to refer herein to any of the type of sectioned or paneled doors used to cover large openings in residential or commercial buildings, where the door is opened in the vertical direction either manually or by powered means. References herein to the vertical and horizontal directions with regard to components on the door assembly 10 shall be in reference to the door assembly 10 when in the vertical or closed position.

In the figures, the garage panel door assembly 10 is shown to comprise a plurality of vertically arranged, laterally extending, panel members 11 each having a horizontal, laterally extending, upper edge 12 and a horizontal, laterally extending, lower edge 13 typically formed by inwardly bending the thin sheet metal composing the panels 11. In the closed position for the door 10 where the opening in the building is obstructed or sealed, the panel members 11 are aligned so as to be co-planar. Vertically adjacent panel members 11 are connected to each other by hinge members 16, whereby each panel member 11 can be pivoted out of co-planar alignment relative to its adjacent panel member 11 when the door 10 is opened and closed. The individual panel members 11 are reinforced with a plurality of stiles or brace members 14, typically rectangular in cross-section, aluminum or like metal tubes which extend vertically between the upper and lower edges 12 and 13, with the hinge members 16 being disposed between corresponding stile members 14. Laterally extending rail members 15 are also typically provided to further brace the panel members 11. Roller members 17 are mounted to the sides of the door assembly 10, the roller members 17 being received by guide track members 18 affixed or mounted to the building structure, the track members 18 having a generally vertical section, a curved section and a generally horizontal section. As the door 10 is raised from the closed position, the individual panel members 11 transition from the vertical orientation to a horizontal orientation, such that the door 10 is maintained on the horizontal section of the track members 18 when not in use. Such panel door assemblies 10 are well known in the art.

With reference in particular to FIGS. 1 through 6, the panel reinforcement assembly 20 is shown to comprise in combination a pair of channel members 21 and a movable locking member 31. Each door assembly 10 is provided with a plurality of panel reinforcement assemblies 20. The channel members 21 are linearly aligned, with an upper channel member 21*a* positioned above a hinge member 16 and a lower channel member 21*b* positioned below the hinge member 16, the channel members 21*a* and 21*b* being mounted to the stile members 14 using mechanical fasteners 26 or like affixation means. Alternatively, the stile members 14 could be constructed with the desired configuration so as to comprise the channel members 21 in an integral unit. Preferably, the channel members 21 are each provided with a beveled or recessed end 26 such that the hinge member 16 can be mounted with mechanical fasteners 26 or the like onto the channel members 21*a* and 21*b*, the beveled ends 26 insuring that the two channel members 21*a* and 21*b* do not obstruct or interfere with the pivoting of the adjacent panel members 11 during opening and closing operations.

The channel members 21 each comprise an elongated base plate 22 with generally perpendicularly extending longitudinal sides 23. Each side 23 transitions into a longitudinally extending flange 24 that extends in the opposite direction to the side 23, i.e., back toward the base plate 22, and which is disposed preferably in parallel to the side 23, such that the combination of the side 23 and the flange 24 defines a longitudinally extending slot 25, which is adapted to receive the flange 34 of the locking member 31. The flanges 24 may be disposed externally or internally to the sides 23. Preferably, the channel members 21 are composed of a thin, lightweight sheet metal such as aluminum.

Mounted in sliding manner to one of the channel members 21*a* or 21*b*, but preferably to the upper channel member 21*a*, is a locking member 31. Locking member 31 comprises an elongated top plate 32 with generally perpendicularly extending longitudinal sides 33. Each side 33 transitions into a longitudinally extending flange 34 that extends in the opposite direction to the side 33 and which is disposed preferably in parallel to the side 33, such that the combination of the side 33 and the flange 34 defines a longitudinally extending slot 35, which is adapted to receive the flange 24 of the channel member 21. The flanges 34 may be disposed externally or internally to the sides 33. Preferably, the channel members 21 are composed of a thin, lightweight sheet metal such as aluminum.

Figure 2:
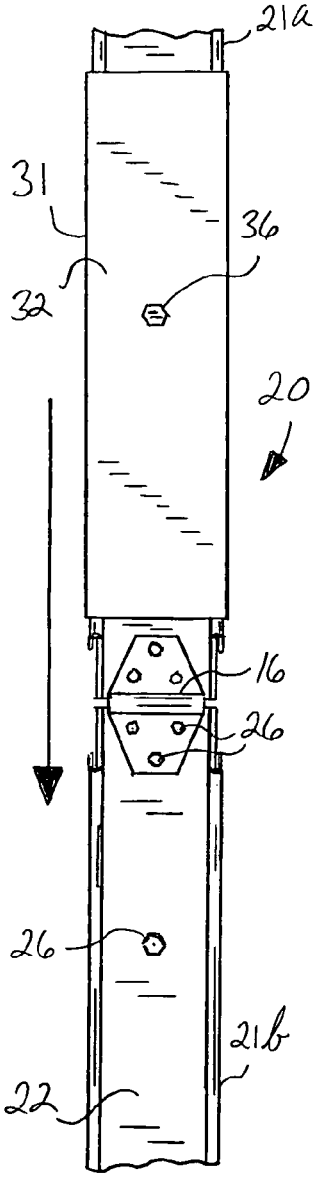
FIG. 2 is a partial front view of the panel reinforcement assembly in the disengaged position.
Figure 3:
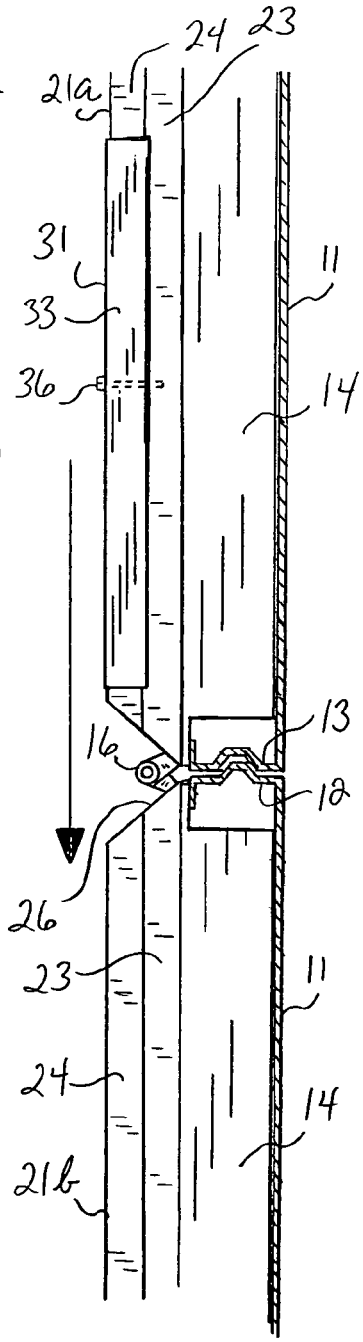
FIG. 3 is a partial side view of the panel reinforcement assembly in the disengaged position.
Figure 4:
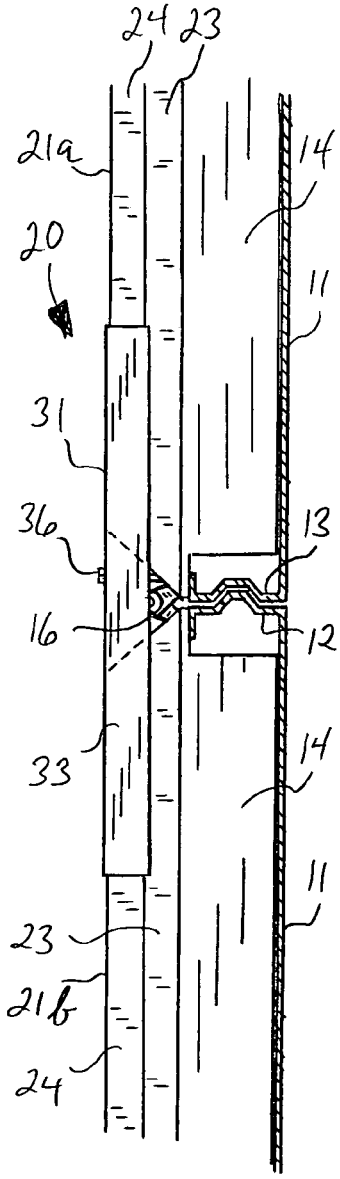
FIG. 4 is a partial side view similar to FIG. 3 but showing the panel reinforcement assembly in the engaged or locked position.
Figure 5:
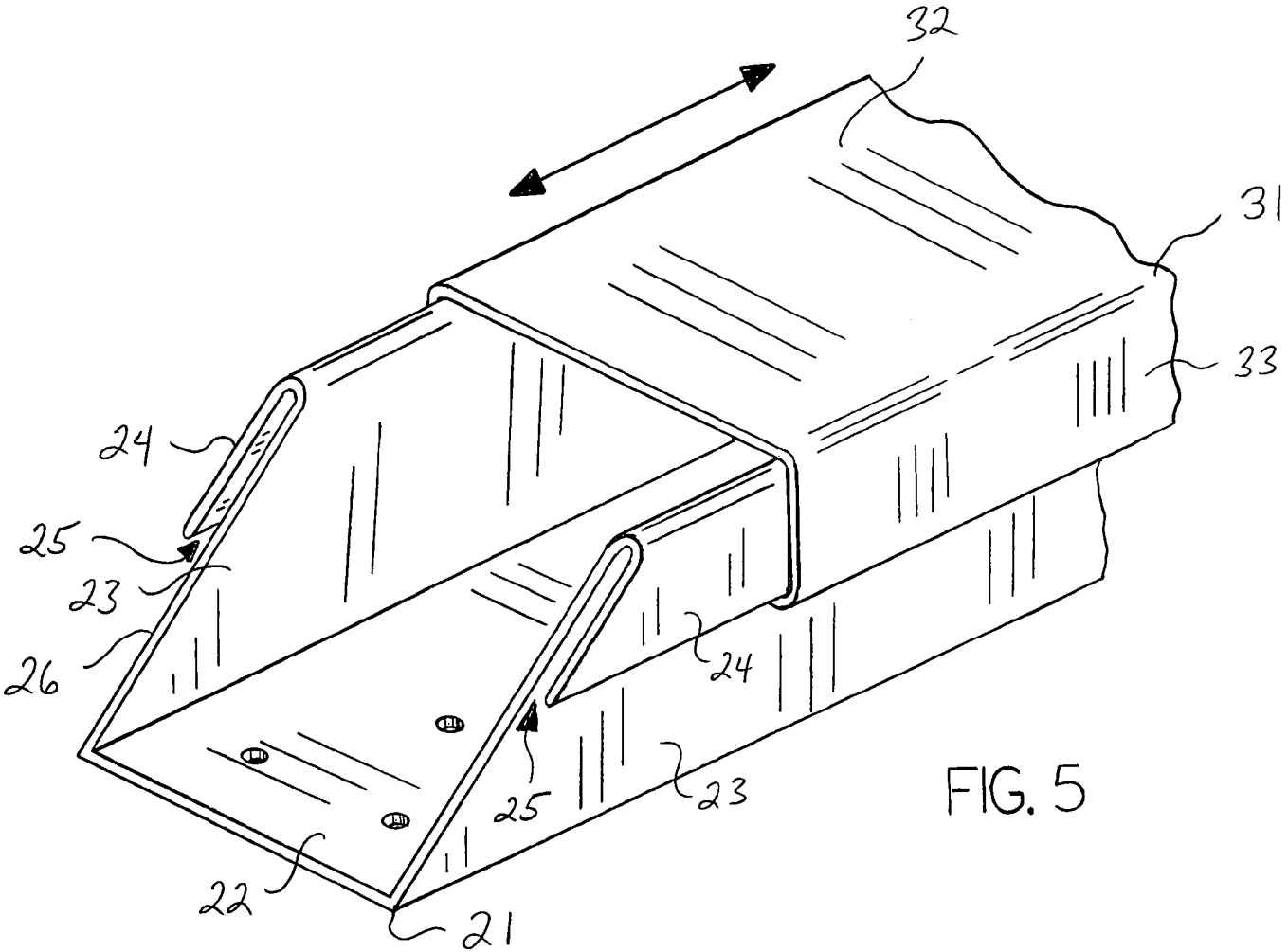
FIG. 5 is a partial perspective view of a channel member and locking member.
Figure 6:
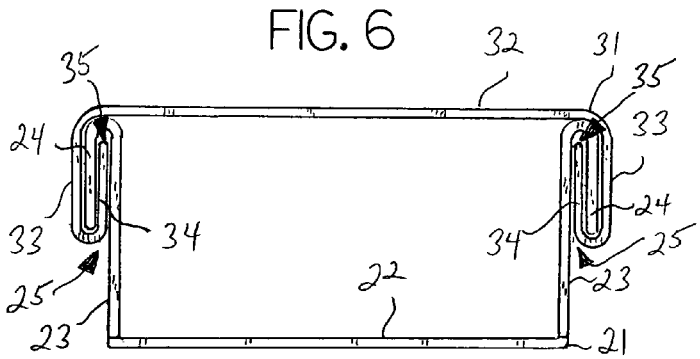
FIG. 6 is an end view of a channel member and locking member.

The channel member sides 23, flanges 24 and slots 25 in combination with the locking member sides 33, flanges 34 and slots 35 define sliding retention means, as shown in FIG. 5, which maintains the locking member 31 in connected manner to the channel member 21*a*, but which allows relative sliding movement between the locking member 31 and the upper channel member 21*a* such that the locking member 33 can be moved from a neutral disengaged position, as shown in FIGS. 2 and 3, to an active engaged position covering the hinge member 33 and mating with the sides 23, flanges 24 and slots 25 of the lower channel member 21*b*, as shown in FIG. 4. In this engaged positioned, the adjoining panel members 11 are precluded from pivoting out of the co-planar position as the joint between the two adjacent panel members 11 is spanned and braced by the locking member 31. Preferably, each hinge member 16 of the door assembly 10 is provided with a panel reinforcement assembly 20 in order to maximize the reinforcement. A stop means 36, such as the pin or bolt member extending through the top plate 32 of the locking member 31, is provided to retain the locking member 31 in the proper location in the engaged position, as well as to provide a means to retain the locking member 31 in the disengaged position. Alternatively, the stop means 36 may comprise abutment members disposed on the lower channel member 21*b*, removable pins laterally positioned through the upper channel member 21*a* and the stile member 14, magnets or other suitable means of retaining the locking member 31 in a desired location until it needs to be moved. Preferably, the locking members 31 are composed of a thin, lightweight sheet metal such as aluminum.

Figure 8:
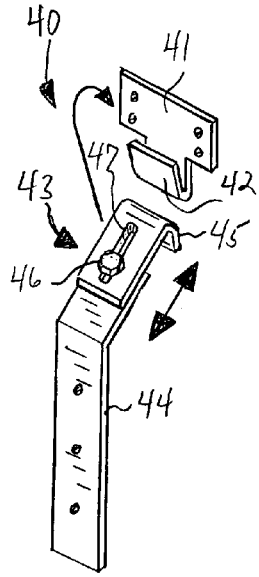
FIG. 8 is a perspective view of the header engagement assembly.
Figure 7:
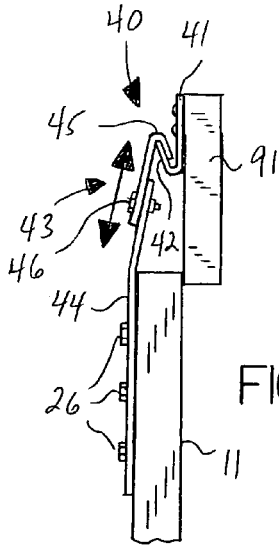
FIG. 7 is a side view of the header engagement assembly.

More preferably, the invention also comprises one or more header engagement assemblies 40, as shown in FIGS. 1, 7 and 8, which are used to temporarily secure the uppermost panel member 11 to building header 91. The header engagement assemblies 40 comprise a header plate 41 that is attached to the building header 91, the header plate 41 comprising an upwardly turned receiving flange or lip 42. A hook assembly 43 is mounted to the uppermost panel member 11, preferably onto a stile member 14 or channel member 21. The hook assembly 43 preferably comprises a mounting plate 44 which is affixed to the stile member 14 or channel member 21 and a separate hook member 45 having a downwardly turned end that corresponds to the header plate flange 42, with the mounting plate 444 and hook member 45 preferably joined in a manner that allows for adjustment of the overall length of the hook assembly 43, such as by the combination of a slot 47 and mechanical fastener 26. Alternatively, the mounting plate 44 and hook member 45 of the hook assembly 43 may comprise a one-piece member. With the door 10 in the closed position, the hook member 45 mates with the receiving flange 42 of the header plate 41 such that inward or outward movement of the uppermost panel member 11 is precluded. When the door 10 is opened, the hook member 45 simply moves vertically out of the receiving flange 42.

Figure 9:
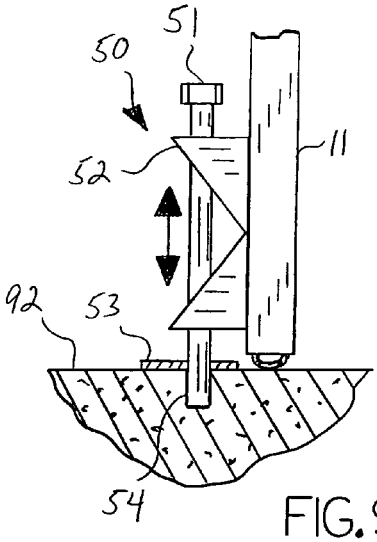
FIG. 9 is a side view of the footer engagement assembly.

Again more preferably, the invention further comprises one or more footer engagement assemblies 50, as shown in FIG. 9, for securing the lowermost panel member 11 to the floor 92 of the building structure. The footer engagement assemblies 50 comprise a movable pin 51 received in vertical manner by a mount member 52 connected to the lowermost panel member 11, preferably onto a stile member 14 or channel member 21, such that the pin 51 can be inserted through an optional floor plate 53 and into a floor recess 54, such that movement of the lowermost panel member 11 in any horizontal direction is precluded. The pin 51 may be supported by a spring, may be formed as non-linear such that rotation of the pin 51 is required for vertical re-positioning, or other means to support the pin 51 in the disengaged positioned may be utilized.

In normal conditions, the movable components of the invention are maintained in the disengaged positions such that opening and closing the door assembly 10 is not interfered with in any manner. In high wind conditions and the door 10 in the closed position, the invention is activated by lowering each of the locking members 31 so as to cover the hinge members 16 and span the gap between adjoining panel members 11, the locking members 31 being joined with a channel member 21 on each side of the hinge members 16. The pin 52 of the footer engagement assembly 50 is lowered into the floor recess 54. The combination of the panel reinforcement assemblies 20, the header engagement assemblies 40 and the footer engagement assemblies 50 creates much more rigid door assembly 10, since the gaps between adjoining panel members 11 are now braced by locking members 31 in combination with the channel members 21, such that any pivoting movement of hinge members 16 is prevented, and the gaps between the uppermost panel member 11 and the header 91 and the lowermost panel member 11 and the floor 92 are now braced by the header engagement assemblies 40 and the footer engagement assemblies 50. The invention thus prevents buckling of the panel members 11 in either the outward or inward direction. After the high wind event has passed, the floor engagement assembly 50 and panel reinforcement assemblies 20 are disengaged by raising the pin 51 and the locking members 31, such that the door assembly 10 is now able to operated in the normal manner.

It is understood and contemplated that equivalents and substitutions to certain elements described above may be obvious to those skilled in the art, and therefore the true scope and definition of the invention is to be as set forth in the following claims.

I claim:

1. A garage door panel reinforcement assembly reinforcing against high wind conditions a pair of adjacent garage door panel members pivotally connected to each other, said reinforcement assembly comprising:

a first U-shaped channel member mounted onto a first panel member;

a second U-shaped channel member mounted onto a second panel member adjacent to the first panel member;

a locking member slidingly mounted onto said first channel member, wherein said locking member is movable from a disengaged position solely on said first channel member to an engaged position on both said first channel member and said second channel member, wherein in said engaged position said first panel member and said second panel member are precluded from pivoting relative to each other;

wherein said first and said second channel members each comprise a base plate, channel member sides extending from said base plate, and channel member flanges extending from said channel member sides in opposite direction to said channel member sides to define a channel member slot, and wherein said locking member comprises a top plate, locking member sides extending from said top plate, and locking member flanges extending from said locking member sides in opposite direction to said locking member sides to define a locking member slot, such that said channel member flanges are received within said locking member slots and said locking member flanges are received within said channel member slots.

2. The reinforcement assembly of claim 1, wherein said first channel member is an upper channel member and said second channel member is a lower channel member.

3. The reinforcement assembly of claim 1, further comprising stop means to retain said locking member in said engaged position.

4. The reinforcement assembly of claim 3, further comprising stop means to retain said locking member in said disengaged position.

5. A garage door panel assembly, said assembly mounted within an opening having a header and a floor and comprising:

at least a pair of adjacent garage door panel members each comprising laterally extending panel members reinforced with stile members, said adjacent garage door panel members pivotally connected to each other by hinge members connected to said stile members;

a first U-shaped channel member mounted onto a stile member on a first said panel member;

a second U-shaped channel member mounted onto a stile member on a second said panel member;

a locking member slidingly mounted onto said first channel member, wherein said locking member is movable from a disengaged position solely on said first channel member to an engaged position on both said first channel member and said second channel member and spanning one of said hinge members, wherein in said engaged position said first panel member and said second panel member are precluded from pivoting relative to each other;

wherein said first and said second channel members each comprise a base plate, channel member sides extending from said base plate, and channel member flanges extending from said channel member sides in opposite direction to said channel member sides to define a channel member slot, and wherein said locking member comprises a top plate, locking member sides extending from said top plate, and locking member flanges extending from said locking member sides in opposite direction to said locking member sides to define a locking member slot, such that said channel member flanges are received within said locking member slots and said locking member flanges are received within said channel member slots.

6. The assembly of claim 5, further comprising stop means to retain said locking member in said engaged position.

7. The assembly of claim 6, further comprising stop means to retain said locking member in said disengaged position.

8. The assembly of claim 5, further comprising at least one header engagement assembly, said header engagement assembly releasably securing one of said garage door panel members to a header.

9. The assembly of claim 5, further comprising at least one header engagement assembly, said header engagement assembly releasably securing one of said garage door panel members to a header;

wherein said header engagement assembly comprises a header plate attached to said header and having a receiving flange, and a hook assembly attached to one of said stile members and having a hook member, whereby with said garage door panel assembly in the closed position, said hook assembly is mated with said receiving flange.

10. The assembly of claim 5, further comprising at least one footer engagement assembly, said footer engagement assembly releasably securing one of said garage door panel members to a floor.

11. The assembly of claim 8, further comprising at least one footer engagement assembly, said footer engagement assembly releasably securing one of said garage door panel members to a floor.

12. The assembly of claim 5, further comprising at least one footer engagement assembly, said footer engagement assembly releasably securing one of said garage door panel members to a floor;

wherein said footer engagement assembly comprises a recess disposed in said floor and a movable pin mounted onto one of said stile members, whereby with said garage door assembly in the closed position, said pin member is received within said floor recess.

13. The assembly of claim 9, further comprising at least one footer engagement assembly, said footer engagement assembly releasably securing one of said garage door panel members to a floor;

wherein said footer engagement assembly comprises a recess disposed in said floor and a movable pin mounted onto one of said stile members, whereby with said garage door assembly in the closed position, said pin member is received within said floor recess.

* * * * *